United States Patent [19]

Baumann

[11] 4,254,950

[45] Mar. 10, 1981

[54] BODY EXERCISE APPARATUS

[75] Inventor: René Baumann, Lucerne, Switzerland

[73] Assignee: Wiba AG, Kriens, Switzerland

[21] Appl. No.: 72,686

[22] Filed: Sep. 5, 1979

[30] Foreign Application Priority Data

Sep. 9, 1978 [DE] Fed. Rep. of Germany ..... 2839300

[51] Int. Cl.[3] ..... A63B 21/00

[52] U.S. Cl. ..... 272/130; 272/134; 272/DIG. 4

[58] Field of Search ..... 272/73, 67, 68, 116, 272/130, 125, 93, 135, 141, DIG. 4

[56] References Cited

U.S. PATENT DOCUMENTS

| | | | |
|---|---|---|---|
| 2,107,447 | 2/1938 | Marlowe | 272/73 |
| 2,107,449 | 2/1938 | Marlowe | 272/73 UX |
| 3,400,793 | 9/1968 | Norris et al. | 272/67 X |
| 3,563,542 | 2/1971 | Wellman et al. | 272/67 X |
| 3,861,677 | 1/1975 | Wheeldon | 272/130 |
| 3,964,742 | 6/1976 | Carnielli | 272/73 |
| 4,149,715 | 4/1979 | Kusmer | 272/67 X |
| 4,157,179 | 6/1979 | Ecklor, Jr. | 272/67 |
| 4,209,167 | 6/1980 | Jansen | 272/67 |

FOREIGN PATENT DOCUMENTS

| | | | |
|---|---|---|---|
| 119746 | 4/1927 | Switzerland | 272/67 |

*Primary Examiner*—Richard C. Pinkham
*Assistant Examiner*—Arnold W. Kramer
*Attorney, Agent, or Firm*—Watson, Cole, Grindle & Watson

[57] ABSTRACT

The body exercising apparatus has a swivel axle (2) arranged in a housing (1), a swivelling lever (3) being attached to the swivel axle. This lever comprises a threaded spindle 7 arranged parallel to a supporting arm (10), which is mounted with its ends in the supporting arm (10) and on which an adjusting nut (5) is arranged. On this one end of a gas spring (4) is hinged, the other end of which is hinged on another adjusting nut (6) which is arranged on a threaded spindle (11) arranged inside the frame (1). Both threaded spindles are disposed in driving connection above cog wheels (16,17) which are arranged in the area of the swivel axle (2). By rotating one of the threaded spindles (11) by means of a hand wheel (30) the distances from the swivel axle (2) of the two spring ends hinged to the two adjusting nuts are altered by the movement of the two adjusting nuts (5,6). By swivelling a crank (20) which is in driving connection with the swivel axle (2) the lever (3) swivels with the one spring end hinged to the latter against the force of the spring. The effective arm length of the lever is modified by the common adjustment of the hinge mountings of both spring ends when the swivel position of the lever is the same. Thus the most varied starting and highest values for muscle building adapted to the individual needs can be set according to choice for the moment curve resulting over the entire swivel field. (FIG. 1).

8 Claims, 8 Drawing Figures

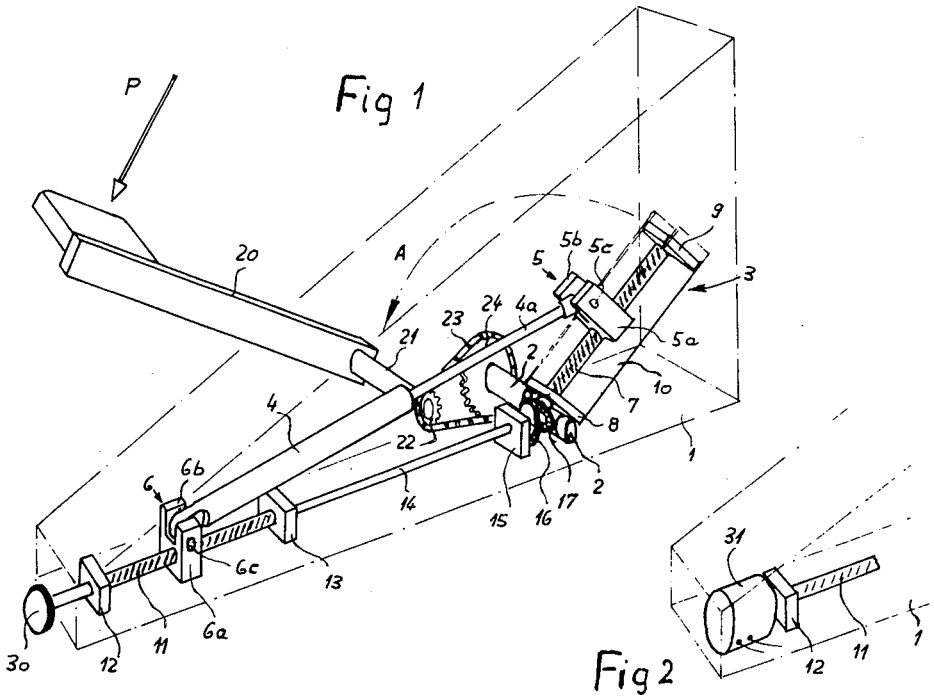
Fig 1
P
A
20
21
23
24
4a
5
5b
5c
9
3
5a
10
7
8
2
1
4
22
14
15
16
17
6
6b
6c
6a
13
11
12
30
Fig 2
31
11
12
1
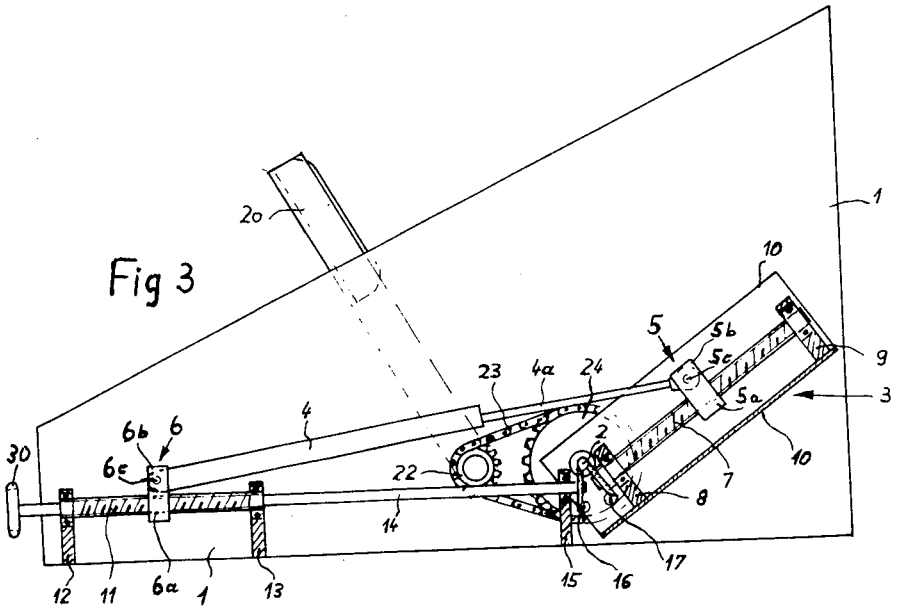
Fig 3
20
1
10
5
5b
5c
9
3
5a
23
4a
24
4
2
7
8
22
14
17
15
16
6b
6
6c
30
12
11
6a
1
13

BODY EXERCISE APPARATUS

The invention relates to body exercising apparatus.

Body exercising apparatus has been proposed in which a counter force, which is as uniformly great as possible, to a body effort exerting on an actuating member, is presented over the entire operating field of the actuating member in order to achieve a uniform stress of the body muscles. For this reason it is suggested that the spring be pre-stressed and the individual parts of the apparatus be mutually arranged in such a manner that a counter-force, which is as constant as possible, is produced because of the geometry at the beginning and during the subsequent movement of the actuating member.

The present invention, however, proceeds from a different objective and tries to establish, for the purpose of muscle building, not a constant counter force but one which alters over a certain field of movement with a maximum between lower values existing at the beginning and at the end of the movement respectively, whereby the knowledge is proceeded from that, for example, during muscle building of the arm the muscles involved exert the greatest effort in a certain position when flexing the arms, the effort being substantially less at the beginning and the end of the flexing movement. A required effort characteristic such as this corresponds more closely to the physiological conditions. For this reason also, exercising apparatuses have been developed in which a weight hanging on a chain is to be moved up and down by the applied muscle effort which the chain is guided over a disc disposed on a shaft. With the external contour of disc shaped as a cardioid the distance of the shaft to the periphery of the disc alters when the disc rotates, which results in a curve-shaped applied effort characteristic with a maximum, because of the leverage of the load which alters with the upward and downward movement of the weight. However, users can be endangered, or at least inconvenienced, by the hanging weight and chain. Also, the apparatus depends for its operation upon appropriate positioning in the gravity field, and may not work satisfactorily on an inclined slope. In addition, exercising apparatus should also have adjustment possibilities in order to be able to adapt it to the individual needs of the person exercising on the apparatus, so that the muscle building can be carried out with counter-force of arbitrary and infinitely variable magnitude. In the apparatus mentioned above this can only be achieved by exchanging the weights or by having a series of weights which can be put together according to selection by inserting a pin for the purpose of taking with it the desired number of weights, which is awkward and makes it necessary to have ready a number of weights, which makes the apparatus unweildy and heavy.

In body exercising apparatus with a lever which can swivel in a frame by means of a swivel axle and with a spring, which is supported at one of its ends against the frame and is hinged at its other end to the lever in an adjustable manner in the longitudinal direction of the lever, there being an actuating member, in order to swivel the lever against the action of the spring in a swivel field limited by two end positions, the perpendicular distance between the swivel axle of the lever and the spring, which distance is the effective length of the lever arm, determines in each lever position in the swivel movement the magnitude of the moment active on the lever, against which the person using the apparatus has to exert a counter effort. The effective arm length of the lever modifies during the swivel movement which results in a curve-shaped moment characteristic with a maximum between two lower values, whereby by the mutual arrangement of springs, lever and swivel axle in the resting position or the starting swivel position, the starting point of the curve of the moment active on the lever is established.

According to the present invention there is provided body exercising apparatus comprising a frame, a lever which can swivel on the frame about a swivel axis, a spring which is attached at its two ends to the frame and to the lever, respectively, by means of first and second mountings which in each case are adjustable in position towards and away from the swivel axis, an actuating member, upon which body effort may be exerted in order to swivel the lever against the action of the spring in a swivel field limited by two end positions which are respectively arranged at acute and obtuse angles to the frame, and adjustment means operable to effect the simultaneous adjustment of the positions of the mountings relative to the swivel axis of the lever so as to alter the moment characteristics of the lever within its swivel field.

Preferably, the spring is a gas spring consisting of a piston/cylinder unit, which has the advantage that it is possible to alter the distance of the spring with respect to the swivel axis without the length of the gas-loaded spring being changed, due to the piston staying in the endposition. Compared with this the adjustment is only possible with spring tension in a known apparatus with a tension spring.

In a preferred development the hinge mountings of the two spring ends consist respectively of an adjusting nut each arranged on a threaded spindle, one end of the spring being hinged respectively to the adjusting nuts, which modify their distances from the swivel axle of the lever when both threaded spindles are rotated. Thereby one of the threaded spindles and two bearings arranged on its ends and also a supporting arm for the bearings thereby form together the swivelling lever arm, while the other threaded spindle is mounted inside the housing of the apparatus by means of two bearings.

Furthermore the ends of the two threaded spindles which appropriately face each other are coupled by means of a gear consisting of two crown wheels which are permanently engaged during the swivel movement of the lever, whereby one of the crown wheels is able to be swivelled around the centre of the swivel axle of the lever relative to the other one and whereby one of the threaded spindles is connected at the end to a drive means for rotating the threaded spindle. In this way the two hinge mountings of the spring ends can be adjusted together.

Further details and advantages of the invention emerge from the following description and the drawings in which an embodiment of the object of the invention is represented purely as an example.

FIG. 1 shows a diagrammatic representation of the strength-building apparatus;

FIG. 2 shows a variant of the apparatus according to FIG. 1, showing a motor drive for the spindle as a section;

FIG. 3 shows a side view of the apparatus according to FIG. 1;

Figure 4:
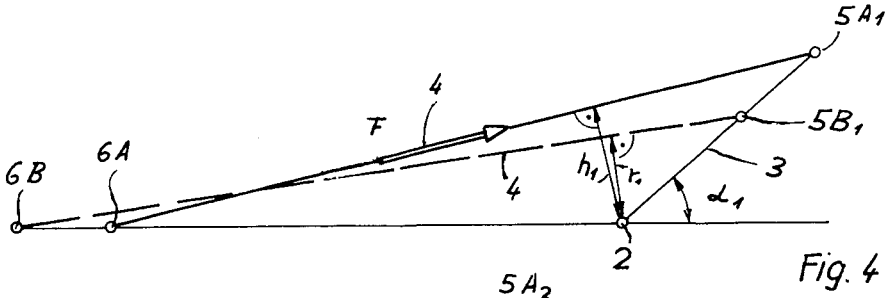
FIGS. 4, 5 and 6 show a schematic representation of the apparatus in three different swivel positions of the spring-loaded lever and with hinge mountings of the spring ends adjusted in each figure from a first to a second distance from the swivel axle.

A swivel axle 2 is mounted in an apparatus frame 1 which is in housing form, to which a swivelling lever 3 is securely connected. A gas spring 4 consisting of a piston/cylinder unit is hinged with one of the ends by means of a hinge mounting 5 to the swivelling lever 3 and with the other end is supported by means of a hinge mounting 6 in the frame 1 of the apparatus. The hinge mounting 5 consists of an adjusting nut 5*a* with a pivot pin 5*c* arranged in a fork-shaped extension 5*b* for attaching the end of the piston rod 4*a* to the gas spring 4. A threaded spindle 7 extends through the adjustig nut 5*a* of the hinge mounting 5, said spindle being held at both ends in bearings 8 and 9. The two bearings are attached to a supporting arm 10 which preferably is in the form of a u-shaped bar and which is only shown with a lower dotted outline edge in order to clarify the drawing, so that the previously mentioned parts located inside this u-shaped bar are able to be recognised in the drawing. The threaded spindle 7, the two bearings 8 and 9 and also the supporting arm 10 thus form together the lever 3 which can swivel around the swivel axle 2.

In a analogous manner the hinge mounting 6 consists of an adjusting nut 6*a* with a pivot pin 6*c* arranged in a fork-shaped extension 6*b*, to which the end of the gas spring 4 on the cylinder side is attached.

A threaded spindle 11 extends through the adjusting nut 6*a* of the hinge mounting 6, said spindle being held in two bearings 12 and 13 which are securely disposed inside the frame 1 of the housing. In extension of the threaded spindle 11 a shaft 14 is connected to the latter, the other end of which is held near the swivel axle 2 in a bearing body 15. On the other side of this bearing body 15 the end of the shaft 14 bears a cog wheel 16, which engages with another cog wheel 17 at the end of the threaded spindle 7. These two cog wheels are so-called crown wheels, in which the teeth are formed in an outer crown projecting over the wheel bodies in axial direction. As emerges clearly from FIG. 3, these two cog wheels 16 and 17 are arranged in such a manner that the rolling point lies on the centre of the swivel axle 2 of the lever. Accordingly the swivel axle has a part mounted in the front wall of the frame 1 of the housing and a part mounted in the rear wall, said two parts being connected to the lever 3 and the two cog wheels 16 and 17 rotate in the space in between. By means of this arrangement the two cog wheels remain engaged when the lever 3 is swivelled by 60°–120° against the action of the spring 4 in the direction of arrow A so that the lever than assumes the position shown in the schematic representation in FIG. 6.

An actuating member in the form of a crank 20 serves to swivel the lever 3 against the action of the spring 4. A shaft 21 connected to the crank 20 is mounted in the frame 1 of the apparatus and bears at the end a chain wheel 22 over which a chain 23 runs, which also runs over a larger chain wheel 24 which is attached at the end of the swivel axle 2. Thus a reduction gearing is inserted between the crank 20 and the swivel axle 2.

In order to adjust together the hinge mountings 5 and 6 of both ends of the gas spring 4, the threaded spindle 11 is rotated by means of a hand wheel 30 arranged at the end, so that the threaded spindle 7 is also rotated by way of the two engaged crown wheels 16 and 17. Since when the length of the gas spring remains constant the adjusting path lengths on the two threaded spindles must be of unequal magnitude for geometrical reasons, either the two threaded spindles have a thread of somewhat different pitch or the two crown wheels form a transmission gearing.

According to FIG. 2 an electro-motor 31 can also be arranged at the end of the threaded spindle 11 for rotating the spindle 11 for adjusting the two hinge mountings 5 and 6 of both ends of the spring 4.

Figure 5:
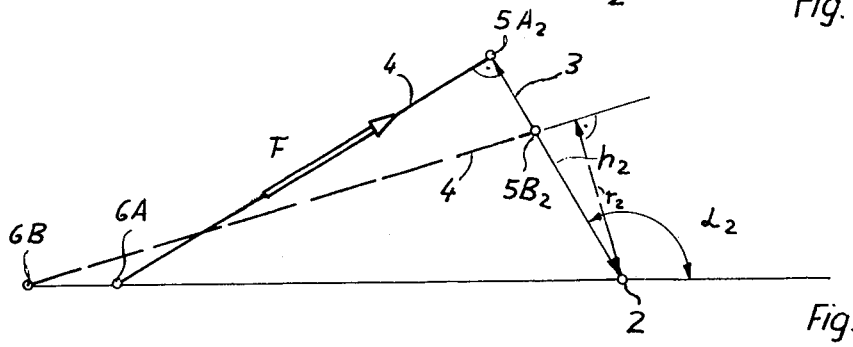
Figure 6:
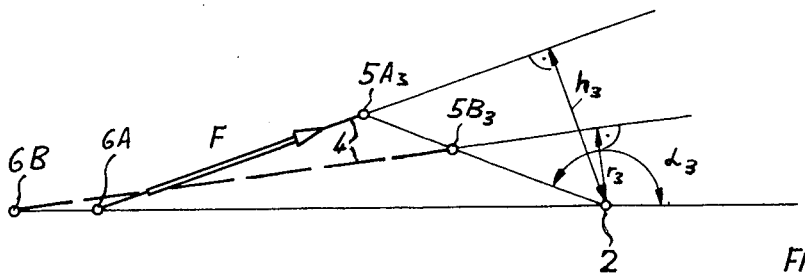
Figure 7:
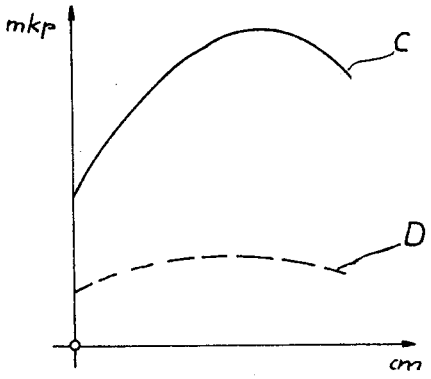
FIG. 7 shows two torque curves which result with the positions of the spring relative to the swivel axle represented in FIGS. 4 to 6.

In FIGS. 4, 5 and 6 three different swivel positions of the lever 3 are shown in schematic representation, on which the end of the spring 4 symbolised by the arrow of force F is attached by means of the hinge mounting 5. The hinge mounting 6 is located in the drawing on the left-hand end of the spring 4. In order to differentiate between two different locations of the hinge mountings on the threaded spindles 7 and 11, not shown in FIGS. 4 to 6, according to FIG. 1 or 3, the two hinge mountings are indicated in a first position with 5A1; 6A. The swivelling lever 3 forms the angles $\alpha_1$, $\alpha_2$, $\alpha_3$ with a horizontal plane running through the swivel axle 2 in the three positions according to FIGS. 4, 5 and 6. It can be seen from the three figures that in the three lever positions the effective arm length of the lever h1, h2 and h3, which is equal to the perpendicular distance between the spring and the swivel axle varies in size and in FIG. 5 is greatest, when the lever 3 and the spring 4 form a right-angle. In FIG. 7 the upper curve C represents the moment shape during the swivel movement. The moment resulting from the effective arm length of the lever and the spring tension, said moment acting on the swivel axle 2, has a maximum between two lower values corresponding to the final positions of the lever. This result corresponds to the set object as described in the introduction.

Furthermore in FIGS. 4, 5 and 6 the position of the hinge mounting at one end of the spring 4 is characterised with the points 5B1 in FIG. 4 and 5B2 in FIG. 5 and finally 5B3 in FIG. 6 indicated on the swivelling lever 3, when the distances of the hinge mountings from the swivel axle 2 have been altered by rotating the threaded spindles. The second hinge mounting at the other end of the spring then reaches point 6B. The spring 4 is indicated in each case with a dotted line. One can see from the figures that in the three swivel positions the effective arm length of the lever r1, r2 and r3 is smaller than the effective arm length of the lever resulting with the respective swivel mountings 5 and 6. In FIG. 7 the lower curve D results for the moment shape. The adjustment of the two hinge mountings 5 and 6 of the spring ends can be carried out infinitely so that a number of such curves results corresponding to the curves C and D in FIG. 7 for the moment shape. This means that the apparatus can be adapted to the individual needs of each user and the exercising can equally be carried out with a gradual increase of the demand of strength provided for according to a set programme.

Figure 8:
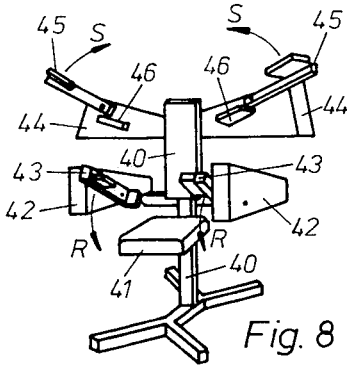
FIG. 8 shows an exercising apparatus with four apparatuses according to FIG. 1 in diagrammatic representation.

In FIG. 8 a device is shown in schematic representation with which a person can carry out muscle building with both arms simultaneously in order to build up the bicep muscles and also the tricep muscles of each arm.

For this purpose a seat 41 is attached to a support 40 according to FIG. 8. Above this seat a strength-building apparatus 42 of the kind described above is attached to the support to the left and right respectively, in which the cranks 43, which correspond to the crank 20 in the apparatus according to FIG. 1 and 3, are to be moved downwards in the direction of arrow R. Two additional apparatuses 44 of the previously described kind are attached further up on the support 40 which are arranged somewhat under 90° to the apparatuses 42, the cranks 45 of which are to be swivelled upwards in the direction of arrow S. Thereby an additional support 46 serves to support the elbow. In the case of the lower apparatus 42 the person in training must bring his lower arm downwards out of the flexed position into the stretched position while pressing the crank 43, while in the upper apparatus 44 the lower arm is to be brought out of the more stretched position against the action of the spring into the flexed position so that with this device both of the previously mentioned arm muscles can be strengthened one after the other.

In a corresponding manner building of the leg muscles or the stomach muscles can also be carried out with the described apparatus.

Summing up, the advantages of the apparatus described above as compared with the previously known apparatuses are to be seen among other things in that in this apparatus the spring works directly on the lever without the insertion of force transmitting ropes for example and a compact assembly in a frame formed as a closed housing is possible because of this construction. Therefore people are not endangered by chains, wheels or weights. Further advantages exist in the fact that the operating method of the apparatus is independent from the force of gravity and that the arrangement of the apparatus in the room is arbitrary, i.e. an oblique position of the axle position is possible because no weighted ropes or chains have to be guided in a certain direction. An apparatus combination for the building of leg muscles is therefore also constructed with oblique axles. Finally the strength curve of the muscle strength aimed towards with the apparatus is correctly adapted physiologically to the human limbs.

I claim:

1. Body exercising apparatus comprising a frame, a lever which can swivel on the frame about a swivel axis, a spring which is attached at its two ends to the frame and to the lever, respectively, by means of first and second mountings which in each case are adjustable in position towards and away from the swivel axis, an actuating member, upon which body effort may be exerted in order to swivel the lever against the action of the spring in a swivel field limited by two end positions which are respectively arranged at acute and obtuse angles to the frame, and adjustment means operable to effect the simultaneous adjustment of the positions of the mountings relative to the swivel axis of the lever so as to alter the moment characteristics of the lever within its swivel field.

2. Apparatus according to claim 1, wherein the spring is a gas spring comprising a piston/cylinder unit.

3. Apparatus according to claim 1, wherein the first and second mountings each comprise an adjusting nut which is arranged on a threaded spindle and to which the associated end of the spring is hingedly connected, the lever then taking the form of one of the threaded spindles, two bearings supporting its ends, and a supporting arm on which the bearings are mounted, and the other threaded spindle being mounted inside said frame by means of two further bearings.

4. Apparatus according to claim 3, wherein the spindles are both extended close to the swivel axis and the facing ends of the two spindle extensions are coupled to one another by means of two intermeshing crown wheels which are permanently in mesh throughout the swivel movement of the lever, so that one of the crown wheels is able to be swivelled around the centre of the swivel axis of the lever relative to the other crown wheel, one of the threaded spindles being connected at one end to drive means for rotating that threaded spindle.

5. Apparatus according to claim 4, wherein the two crown wheels form a transmission gearing, by means of which one of the threaded spindles is driven with a greater number of rotations than the other threaded spindle when rotated, such that the moment characteristics of the lever can be adjusted without substantially affecting the length of the spring or the locations of said end positions limiting said swivel field.

6. Apparatus according to claim 3, wherein both threaded spindles have threads with different pitch, such that the moment characteristics of the lever can be adjusted without substantially affecting the length of the spring or the locations of said end positions limiting said swivel field.

7. Apparatus according to claim 1, wherein the lever is securely connected to a swivel axle having its longitudinal axis coincident with said swivel axis, and the actuating member is a crank which is in driving connection with the swivel axle so as to rotate it against the action of the spring.

8. Apparatus according to claim 7, wherein reduction gearing is coupled between the crank and the swivel axle.

* * * * *